US006287142B1

(12) United States Patent
Sawayanagi et al.

(10) Patent No.: US 6,287,142 B1
(45) Date of Patent: Sep. 11, 2001

(54) BRACKET FOR ATTACHING SUN VISOR PROVIDED WITH ELECTRIC EQUIPMENT ONTO VEHICLE BODY

(75) Inventors: Masahiro Sawayanagi, Shizuoka; Toshiya Togi, Tokyo, both of (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 09/742,098

(22) Filed: Dec. 22, 2000

(30) Foreign Application Priority Data

Dec. 24, 1999 (JP) ..... 11-368021

(51) Int. Cl.[7] ..... H01R 13/60

(52) U.S. Cl. ..... 439/537; 439/351; 439/553; 439/567; 439/883

(58) Field of Search ..... 439/351, 361, 439/537, 553, 567, 801, 883

(56) References Cited

U.S. PATENT DOCUMENTS

| | | | | |
|---|---|---|---|---|
| 3,798,584 | * | 3/1974 | Person | 439/102 |
| 3,985,417 | * | 10/1976 | Fenton | 439/334 |
| 4,323,879 | * | 4/1982 | Kelley | 340/134 |
| 4,426,126 | * | 1/1984 | De Vos et al. | 439/572 |
| 4,645,286 | * | 2/1987 | Isban et al. | 439/571 |
| 4,952,157 | * | 8/1990 | Hudson et al. | 439/92 |
| 5,558,537 | * | 9/1996 | Su | 439/537 |
| 5,752,853 | * | 5/1998 | Curtindale | 439/567 |
| 5,808,556 | * | 9/1998 | Nelson et al. | 340/693 |

FOREIGN PATENT DOCUMENTS

| | | | |
|---|---|---|---|
| 56-175250 | 5/1955 | (JP) . | |
| 63-72115 | 5/1988 | (JP) | B60J/3/02 |
| 64-22620 | 1/1989 | (JP) | B60J/3/02 |
| 7-47839 | 2/1995 | (JP) | B60J/3/02 |
| 11-78521 | 3/1999 | (JP) | B60J/3/02 |
| 11-507309 | 6/1999 | (JP) | B60J/3/00 |

* cited by examiner

*Primary Examiner*—Brian Sircus
*Assistant Examiner*—Thanh-Tam T Le
(74) *Attorney, Agent, or Firm*—Sughrue, Mion, Zinn, Macpeak & Seas, PLLC

(57) ABSTRACT

A base member 37 is disposed between a roof panel 33 and a roof trim 35 and attached to the roof panel 33 by means of a panel engagement member 51. The base member 37 is provided with a first connecting section 53 for holding a terminal 41*a* of a power supply electric wire 41. A bracket body 39 attached with a shaft 38 of a sun visor body is provided with protrusions 39*a* to be engaged with elastic pieces 52 formed with the base member 37. The bracket body 39 is also provided with a second connecting section 34 for holding a terminal 56 of a connection electric wire 42*a* and a third connecting section 36 for holding a terminal 57 of an electric wire 42*b* for earth. A first conductive screw 43 piercing the first and second connecting sections fixes the bracket onto the base member 37 and an engagement hole 33*a* together with a second conductive screw 45 piercing through the third connecting section and a screw hole 33*c*.

3 Claims, 9 Drawing Sheets

BRACKET FOR ATTACHING SUN VISOR PROVIDED WITH ELECTRIC EQUIPMENT ONTO VEHICLE BODY

BACKGROUND OF THE INVENTION

The present invention relates to a bracket for attaching a sun visor having electric equipment to a vehicle body in which an illumination device, the electric power of which is supplied from wire harness arranged on a roof of a vehicle, is provided.

A sun visor has been recently developed which is arranged on a roof of a front seat of a vehicle and provided with a vanity mirror. Further, a sun visor has been recently developed which is provided with not only a vanity mirror but also an illumination device used for the vanity mirror.

FIG. 12 is a view showing an attaching structure of a related sun visor having an illumination device, which is disclosed in Japanese Utility Model Publication No. 56-175250U.

As shown in FIG. 12, the related sun visor 1 includes: a sun visor body 2 provided with a vanity mirror 3 having a lamp for illumination; and a shaft 5 pivotably attached to the sun visor body 2, wherein this shaft 5 is an attaching section attached to a roof trim 4*a* and a roof panel 4*b* of a vehicle An electric wire 7 for connection passes in the shaft 5 of the sun visor 1 having an illumination device, and one end of the electric wire 7 for connection is connected with the illumination lamp, and the other end of the electric wire 7 for connection is connected with an electric wire 9 for supplying electric power, which is the wire harness on the vehicle side, via connectors 7*a*, 9*a*. Further, the illumination lamp and the shaft 5 are connected with each other by an electric wire 11 for earth.

The sun visor 1 having an illumination device described above is attached onto the vehicle body side as follows. The connector 9*a* of the power supply electric wire 9 is previously drawn out from an opening 12, which is used for harness connection, of the roof trim 4*a* and the roof panel 4*b*. After the connector 7*a* of the connection electric wire 7 has been connected with the connector 9*a*, the connectors 7*a*, 9*a* are pushed into a space in the roof section 8 of the vehicle body from the opening 12. Then the shaft 5 is fixed to the roof trim 4*a* and the roof panel 4*b* by screws 13. In this way, the sun visor 1 having an illumination device can be attached to a roof section 8 of the vehicle body.

However, the space in the roof section 8 of the vehicle body is small. Therefore, when the connectors 7*a*, 9*a* are pushed into the space, there is a probability that the connectors 7*a*, 9*a* are pinched in the small space.

Further, in order to connect the electric wires after the power supply electric wire 9, which has been once arranged in the vehicle body roof section 8, is drawn out from the opening 12, length of the power supply electric wire 9 must be extended. Accordingly, there is a probability that a redundant portion of the power supply electric wire 9 is contacted with other portions and damaged.

Furthermore, the connection work of this connector is complicated, because the connector must be connected while the sun visor body 2 is being held by one hand of a worker or while the sun visor body 2 is kept hanging when the connector 9*a* of the power supply electric wire 9 and the connector 7*a* of the connection electric wire 7 are connected with each other.

In order to prevent the occurrence of the above problems, for example, another related structure is proposed in Japanese Patent Publication No. 64-22620A.

In this sun visor 21 having an illumination device, as shown in FIG. 13, a mirror 3 indicated by phantom lines and the illumination lamp used when this mirror 3 is used are attached to a sun visor body 22. A connection electric wire.7, one end of which is connected with this illumination lamp, is inserted into a shaft 23, one end of which is attached to the sun visor body 22. An upper end of the shaft 23 is provided with a contact 26.

The upper end of the shaft 23 provided with the contact 26 is inserted into a hole formed in a bracket 25, and the lower end of the shaft 23 attached to the sun visor body 22 is connected with an electric wire 11 for earth of the illumination lamp.

On the other hand, a connector 24 is attached to a roof trim 4*a* arranged in a vehicle body roof section 8, so that this connector 24 is accommodated in a roof panel 4*b*. In this connector 24, there is provided a recess section 24*a* capable of accommodating a protruding portion of the bracket 25. In this recess section 24*a*, a contact 9*b*, which is arranged at one end of a power supply electric wire 9, is arranged in such a manner that the contact 9*b* is pushed by a coil spring 27 provided between the contact 9*b* and the connector 24.

The sun visor body 22 is attached as follows. First, a protruding portion of the sun visor bracket 25 is accommodated in the recess section 24*a* of the connector 24. Then, the contact 26 of the connection electric wire 7 comes into contact with the contact 9*b* of the power supply electric wire 9, and these contacts 26, 9*b* are electrically contacted with each other. At this time, the contact 9*b* is pushed by the coil spring 27 and elastically contacted with the contact 26. Therefore, even if a small tolerance is caused in the assembling work, the contacts 26, 9*b* can be positively contacted with each other.

When a flange 23*a* for attaching the bracket 25 is attached to the roof trim 4*a* and the roof panel 4*b* by screws 28, the electric wire 11 for earth of the illumination lamp is connected with the roof panel 4*b* via the shaft 23 and the bracket 25. In this way, electric power can be supplied to the illumination lamp.

Accordingly, connection of the electric wires of the sun visor 21 having an illumination device can be completed only when the shaft. 23 is inserted into the connector 24, that is, it is substantially unnecessary to conduct a connection work. In other words, the assembling work becomes easy. Further, it is unnecessary to draw out the power supply electric wire 9 for the purpose of connection, and length of the power supply electric wire 9 can be reduced.

Even in the case of the sun visor 21 having an illumination device described above, when the sun visor bracket 25 is attached to the roof trim 4*a* and the roof panel 4*b* by screws, a worker must hold the bracket 25 by one hand while a protruding portion of the bracket 25 is being accommodated in the recess 24*a* of the connector 24. Therefore, the worker must position and fasten the screws 28 by the other hand. Accordingly, the attaching work can not be efficiently conducted.

SUMMARY OF THE INVENTION

The present invention has been accomplished to solve the above problems. It is an object of the present invention to provide a bracket for attaching a sun visor having electrical equipment to a vehicle body characterized in that: no damage is caused and no breaking of wire is caused when it is attached; and the attaching facility is excellent.

In order to achieve the above object, according to the present invention, there is provided a modular connector for attaching an interior equipment of a vehicle onto an interior wall member covering an inner face of a vehicle body panel, comprising:

a plate-shaped base member provided with a through hole, and disposed between the vehicle body panel and the interior wall member such that the through hole is arranged on an opening formed in the interior wall member;

a fitting member formed on the base member, which is fitted into a fitting hole formed in the vehicle body panel;

a bracket provided with a base plate to which the interior equipment is attached and a cylindrical portion protruded from the base plate which is to be inserted through the through hole of the base member so as to hold the interior wall member therebetween;

a provisional engagement member formed on the bracket, which is engaged with the base member provisionally when the cylindrical portion is inserted into the through hole of the base member;

a first electric wire arranged between the vehicle body panel and the interior wall member, and led out from the through hole of the base member;

a first terminal provided on a leading end of the first electric wire and fixed on the base member so as to face the bracket;

a second electric wire and a third electric wire led out from the interior equipment and extending through the inside of the cylindrical portion of the bracket;

a second terminal provided on a leading end of the second electric wire and fixed on the base plate of the bracket at a portion opposing to the first terminal when the bracket is engaged with the base member;

a third terminal provided on a leading end of the third electric wire and fixed on the base plate of the bracket;

a first conductive screw piercing through the first and second terminals for electrically connecting the first and second electric wires and for fixing the bracket onto the base member; and a second conductive screw piercing through the third terminal and the vehicle body panel for grounding the third electric wire and for fixing the base member onto the vehicle body panel.

In this configuration, the base member is previously engaged with the vehicle body panel by the fitting member. Due to the foregoing, the bracket provided with the provisional engagement member can be provisionally engaged with the vehicle body. Therefore, when the first and second conductive screw are fastened, it is unnecessary for a worker to hold the bracket with his hand. Therefore, the attaching facility can be enhanced.

Only when the bracket is fixed to the base member and the vehicle body panel by the first and second conductive screw, the first terminal and the second terminal can be conducted with each other, and at the same time the third terminal and the vehicle body panel can be conducted with each other. Therefore, it is unnecessary for a worker to conduct a connector engaging work for connecting the terminals. Further, it is unnecessary to provide high accuracy for the dimension of the provisional engagement member.

In the case of maintenance in which the interior equipment is removed from the vehicle body panel, the first and second conductive screw may be removed, and then the bracket may be disconnected from the base member by disengaging the bracket from the base member which have been engaged with each other by the provisional engagement member. Therefore, the base, member to hold the first terminal can be left on the vehicle body panel side and also on the interior wall member side by the fitting member.

Due to the foregoing, the number of parts to be removed in the case of maintenance can be decreased, and an excessively high tension does not act on the first electric wire in the case of removing parts. Accordingly, the maintenance facility can be enhanced.

Preferably, the base member is provided with an engagement member for engaging with the opening of the interior wall member.

In this configuration, after the base member has been attached to the interior wall member by the engagement member, the bracket is provisionally fixed to the base member by the provisional engagement member. Due to the foregoing, the base member, bracket and interior wall member can be integrated into one body, that is, the base member, the bracket and interior wall member can be handled in a state of module. Therefore, storing and assembling can be efficiently conducted.

Preferably, the fitting member has a cylindrical body in which the first conductive screw is inserted so as to expand the cylindrical body outwards.

In this configuration, when the fitting member is also used as a screwing section of the first conductive screw by which the first and second terminals are screwed, the structure of the base member can be simplified. The first conductive screw can penetrate the engaging hole without causing an electrical short circuit which is caused when the forward end portion of the conductive screw comes into contact with the vehicle body panel. Therefore, the terminals can be positively screwed to each other, and the bracket and the base member can be strongly fixed to the vehicle body panel.

DETAILED DESCRIPTION OF THE PREFERRED EMBODIMENTS

Referring to the appended drawings, preferred embodiments of a bracket for attaching a sun visor having electric equipment of the present invention will be explained in detail as follows.

Figure 1:
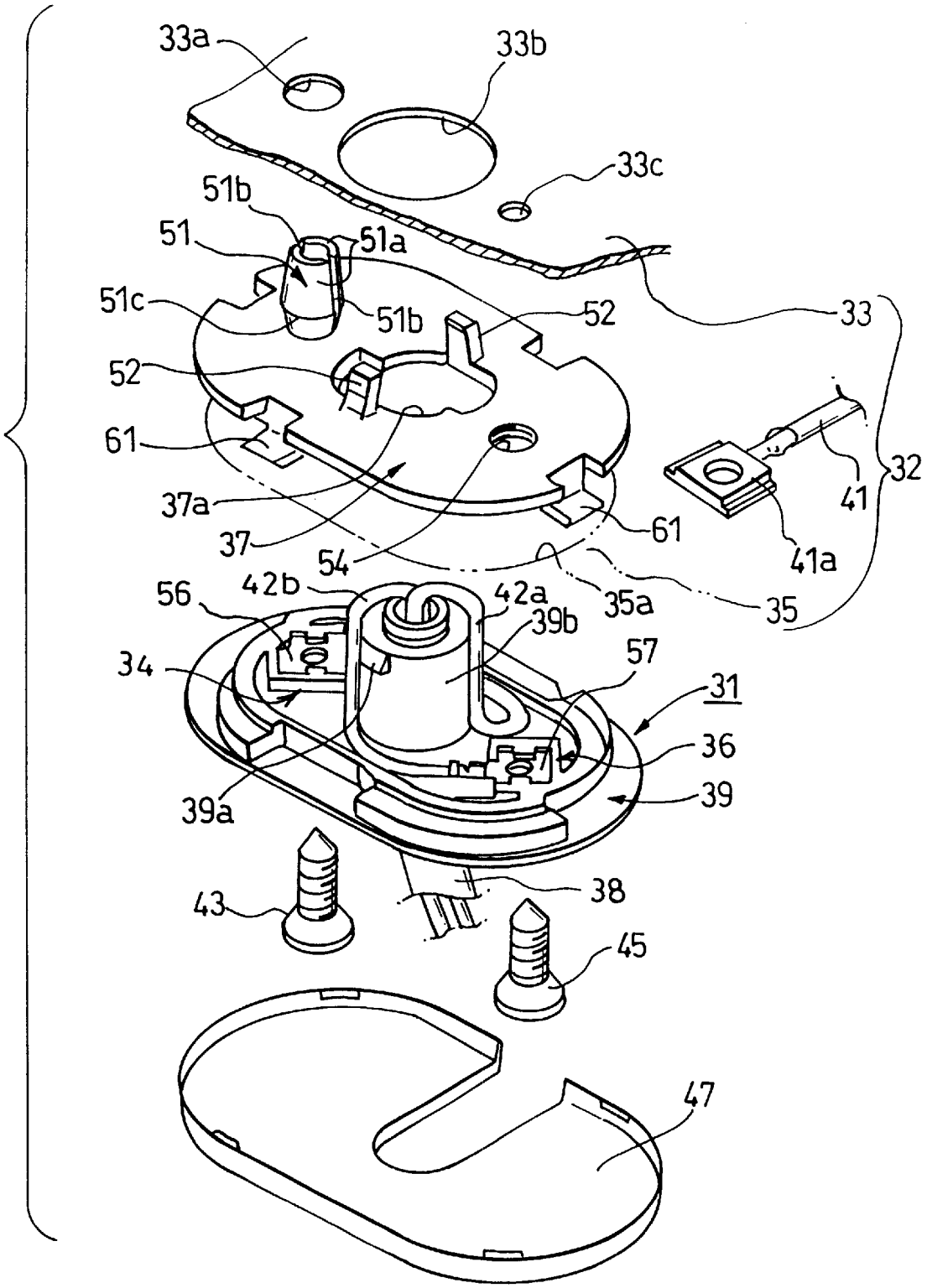
FIG. 1 is an exploded sectional view showing a bracket for attaching a sun visor having an illumination device according to a first embodiment of the present invention.

As shown in FIG. 1, a bracket 31 for attaching a sun visor 70 having an illumination device includes: a base member 37 interposed between a roof panel 33, which is a vehicle body panel, and a roof trim 35 which is an interior wall member incorporated onto the room side so as to cover a surface of the roof panel 33; a bracket body 39 attached to one end of a shaft 38 which is attached to a sun visor body not shown in the drawing; a first conductive screw 43 and a second conductive screw 45 for fixing the base member 37 and the bracket body 39 to the roof panel 33; and a cover 47 for covering a surface on the room side of the bracket body 39.

Figure 2:
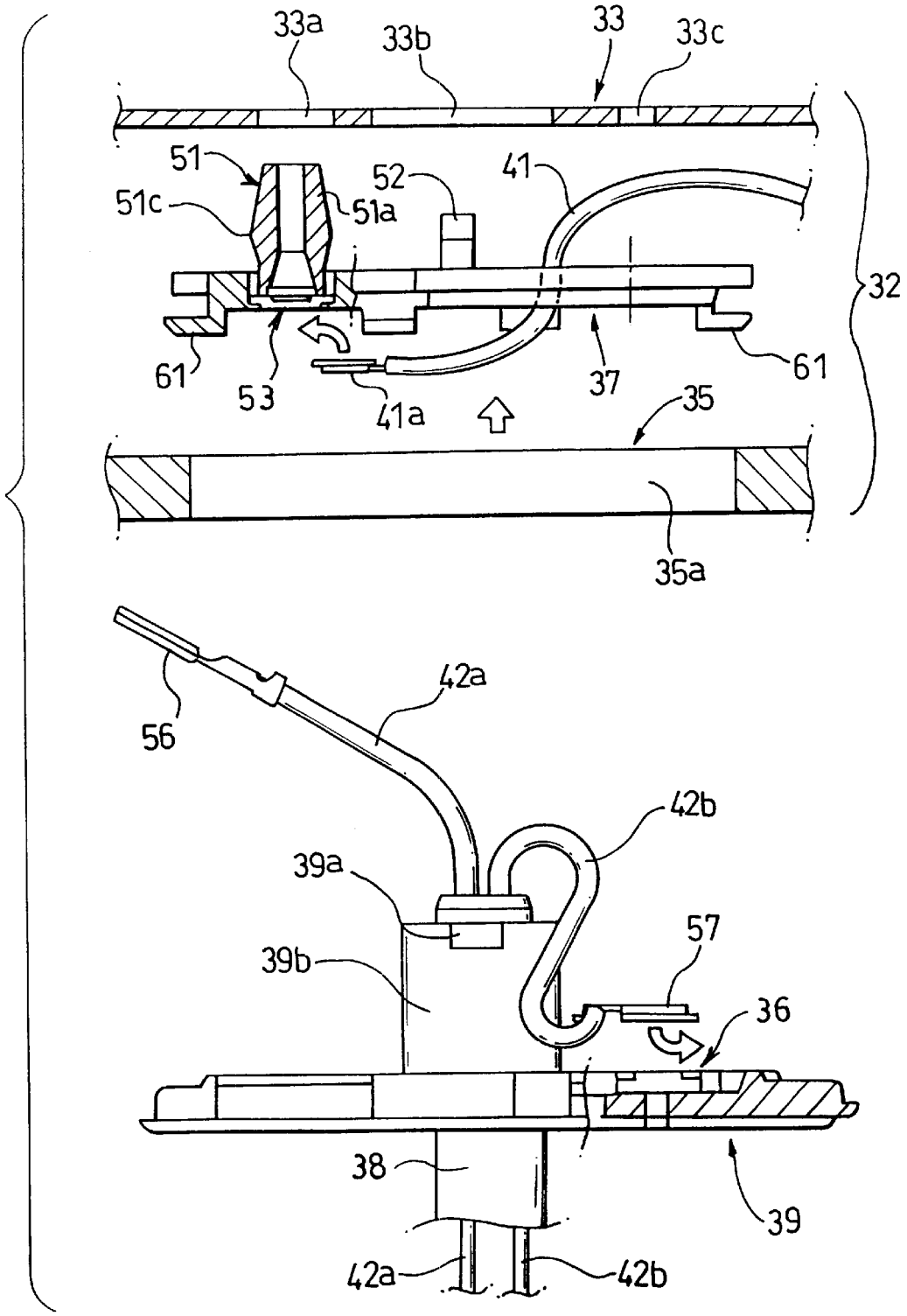
FIGS. 2 to 5 are sectional views for explaining a procedure to assemble the bracket attached to the vehicle body shown in FIG. 1.

The base member 37 made of insulating material such as synthetic resin includes a panel engagement member 51 to be engaged with an engaging hole 33*a* of the roof panel 33. As shown in FIG. 2, on a surface on the bracket body 39 side of the panel engagement member 51, there is provided a first connecting section 53 for holding a terminal 41*a* of an electric wire 41 for supplying electric power which is arranged on the vehicle body side.

Figure 6:
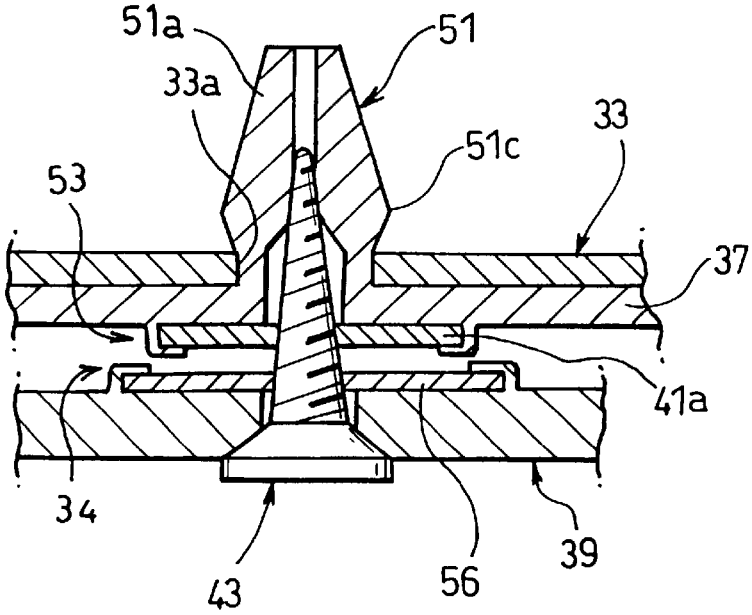
FIG. 6 is an enlarged sectional view of a main portion showing a state of the electrical connection between the terminal of the power supply electric wire and the terminal of the connection electric wire is made; in the bracket attached to a vehicle body shown in FIG. 1.

As shown in FIGS. 1 and 6, the panel engagement member 51 is a substantially cylindrical protrusion press-fitted into the. engaging hole 33*a* formed on the roof panel 33. A pair of circumferential walls 51*a*, which are divided by the longitudinal slits can be elastically displaced in the radial direction. On each circumferential wall 51*a* divided as described above, there is provided an extended diameter section 51*c*, the outer diameter of which is larger than the inner diameter of the engaging hole 33*a*. This extended diameter section 51*c* is hooked at the engaging hole 33*a*, so that engagement can be accomplished.

A through-hole of the panel engagement member 51 is communicated with the first connecting section 53 and also serves as a screwing section of the first conductive screw 43. When the first conductive screw 43 is inserted into the through hole, each circumferential wall 51*a* is elastically displaced in the radial direction, so that the panel engagement member 51 can be fastened to the engaging hole 33*a*.

At the center of the base member 37, there is provided an opening 37*a* into which a cylindrical section 39*b* protruding from the center of the bracket body 39 is inserted. Further, at the periphery of the opening 37*a*, there is provided elastic pieces 52 composing the provisional engagement member for detachably engaging with protrusions 39*a* protruding from the outer circumference of the cylindrical section 39*b* so that the bracket body 39 can be detachably retained on the base member 37.

In the base member 37, there is provided an insertion hole 54, which is located on the opposite side to the panel engagement member 51 with respect to the opening 37*a*, into which the second conductive screw 45 is inserted. The diameter of this screw insertion hole 54 is larger than the diameter of the thread ridge of the conductive screw 45.

In this connection, at the outer circumferential edge of the base member 37 of this embodiment, there is provided a trim engagement member 61 for engaging the base member 37 with the roof trim 35 when the trim engagement member 61 is engaged with an opening 35*a* of the roof trim 35.

In this connection, the trim engagement member 61 is composed in such a manner that a holding piece integrated with the base member 37 holds the opening edge of the opening 35*a* of the roof trim 35.

Figure 7:
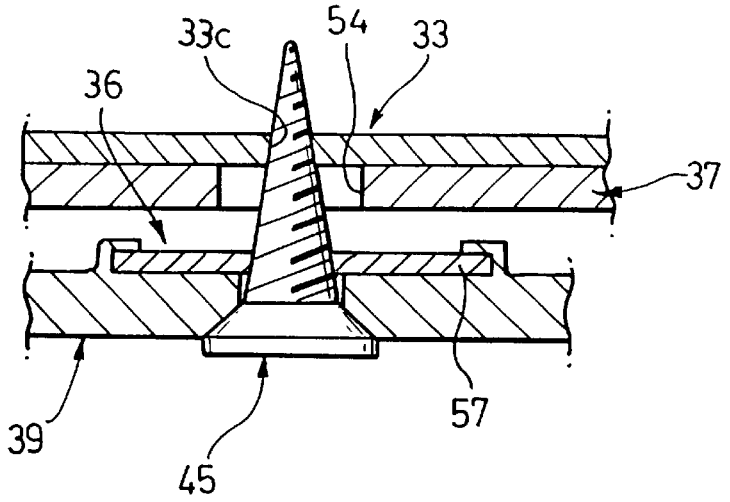
FIG. 7 is an enlarged sectional view of a main portion showing a state of the electrical connection between the terminal of the electric wire for earth and the vehicle body panel.

As shown in FIG. 1, the bracket body 39 made of insulating material such as synthetic resin includes: a second connecting section 34 for positioning and holding a terminal 56 of a connection electric wire 42*a* on the sun visor side corresponding to the first connecting section 53; and a third connecting section 36 for positioning and holding a terminal 57 of an electric wire 42*b* for earth corresponding to the screw insertion hole 54. In this connection, these connecting sections 53, 34, 36 are composed of recess sections capable of accommodating the terminals 41*a*, 56, 57 and also composed of retaining claws as shown in FIGS. 6 and 7.

Each of the terminals 41*a*, 56, 57 is composed in such a manner that a screw insertion hole is formed on a rectangular plate section for screwing. The inner diameters of the screw insertion holes are a little smaller than the outer diameters of the conductive screws 43, 45 so that electrical connections can be positively accomplished between the first conductive screw 43 and the second conductive screw 45 and the terminals 41*a*, 56, 57 when the first and second conductive screws 43 and 45 are screwed. The inner diameter of the screw hole 33*c* of the roof panel 33 into which the second conductive screw 45 is inserted is a little smaller than the outer diameter of the screw section of the second conductive screw 45. In this connection, the first and second conductive screws 43 and 45 are tapping screws by which thread ridges can be formed in the engaging sections of the opponents.

Next, explanations will be made into the procedure by which the sun visor 70 of this embodiment is attached to the roof 32 of a vehicle, the surface of the roof panel 33 of which is covered by the roof trim 35.

Figure 3:
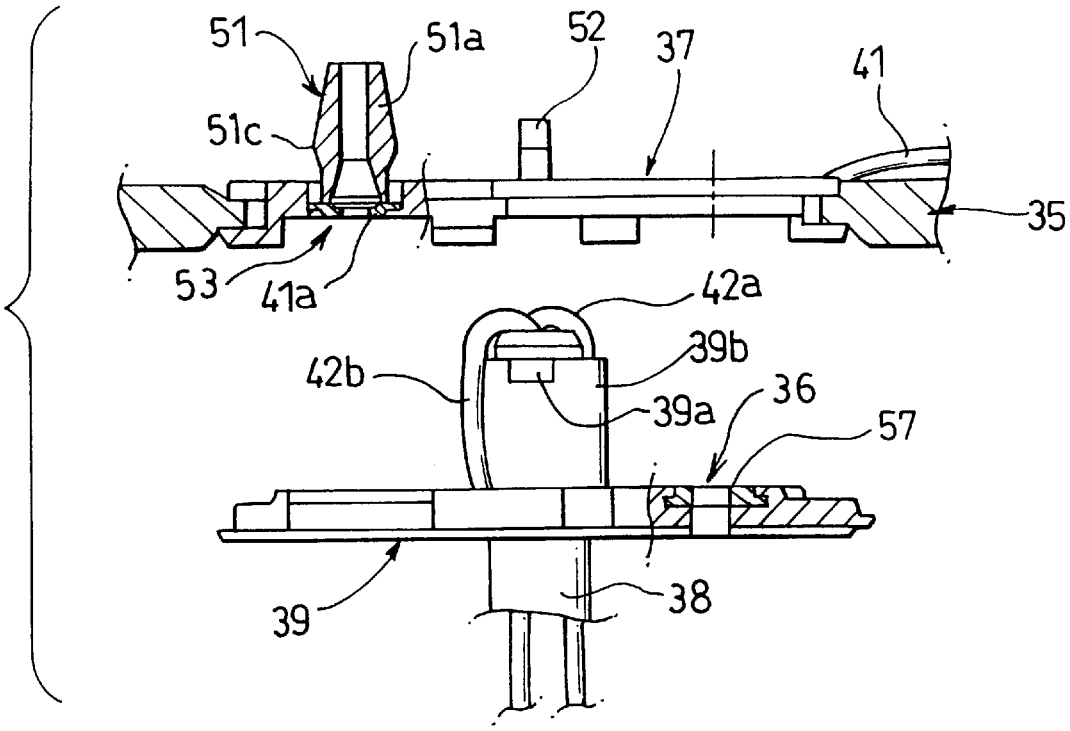

First, as shown in FIGS. 2 and 3, after the terminal 41*a* of the power supply electric wire 41, which is arranged along the outside (surface on the roof panel 33 side) of the roof trim 35, has been positioned and held at the first connecting section 53 of the base member 37, the base member 37 is attached to the opening 35*a* of the roof trim 35 by the trim engagement member 61 (shown in FIG. 3).

The terminal 56 of the connection electric wire 42*a*, one end of which is connected with the illumination lamp of the sun visor 70 having an illumination device not shown, and the terminal 57 of the electric wire 42*b* for earth are respectively positioned at and held by the second 34 and the third connecting section 36 of the bracket body 39.

Figure 4:
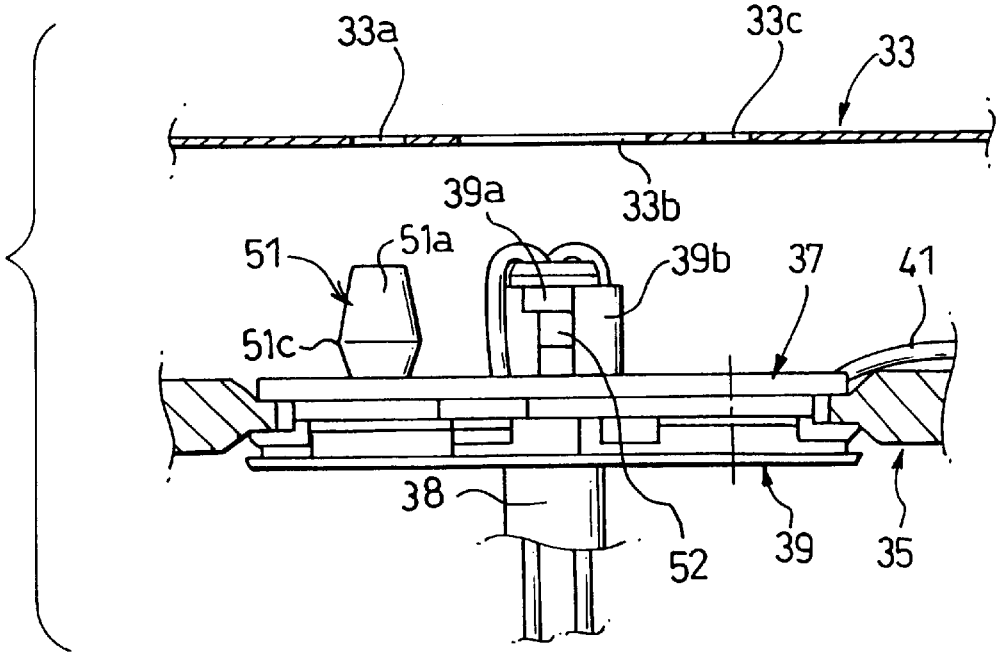

Next, as shown in FIG. 4, the cylindrical section 39*b* of the bracket body 39 is inserted into the opening 37*a* of the base member 37. When the protrusions 39*a* protruding from the outer circumference of the cylindrical section 39*b* are engaged with the elastic pieces 52 of the base member 37, the bracket body 39 can be provisionally engaged with the base member 37 attached to the roof trim 35.

Figure 8:
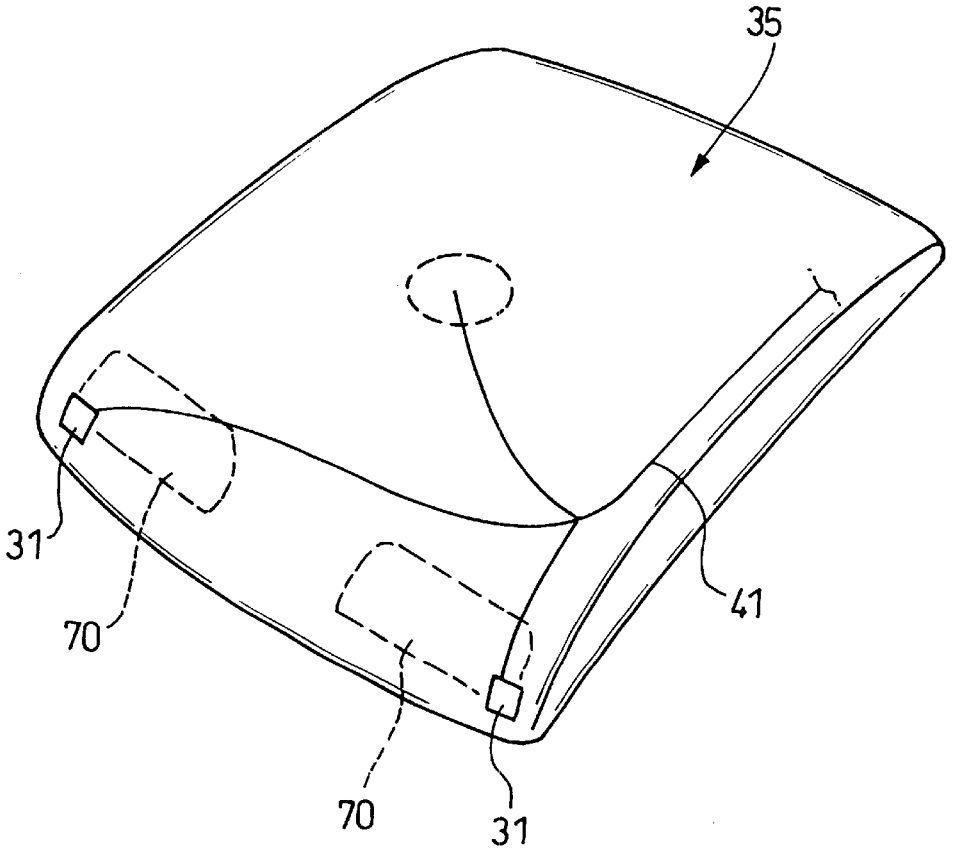
FIG. 8 is a perspective view showing an outline of a roof module in which the bracket is incorporated.

Therefore, as shown in FIG. 8, the roof trim 35 of this embodiment can be handled as a roof module in which the sun visor 70 having an illumination device is previously integrated into a single module via the bracket 31 (base member 37 and bracket body 39). Therefore, storing and assembling can be efficiently conducted.

Next, the roof trim 35 with which the sun visor 70 having an illumination device is provisionally engaged via the bracket 31 is attached to the roof panel 33. In this case, when the panel engagement member 51 of the base member 37 is press-fitted into the engaging hole 33*a* of the roof panel 33, the extended diameter section 51*c* of the panel engagement member 51 is hooked at and engaged with the engaging hole 33*a*.

Figure 5:
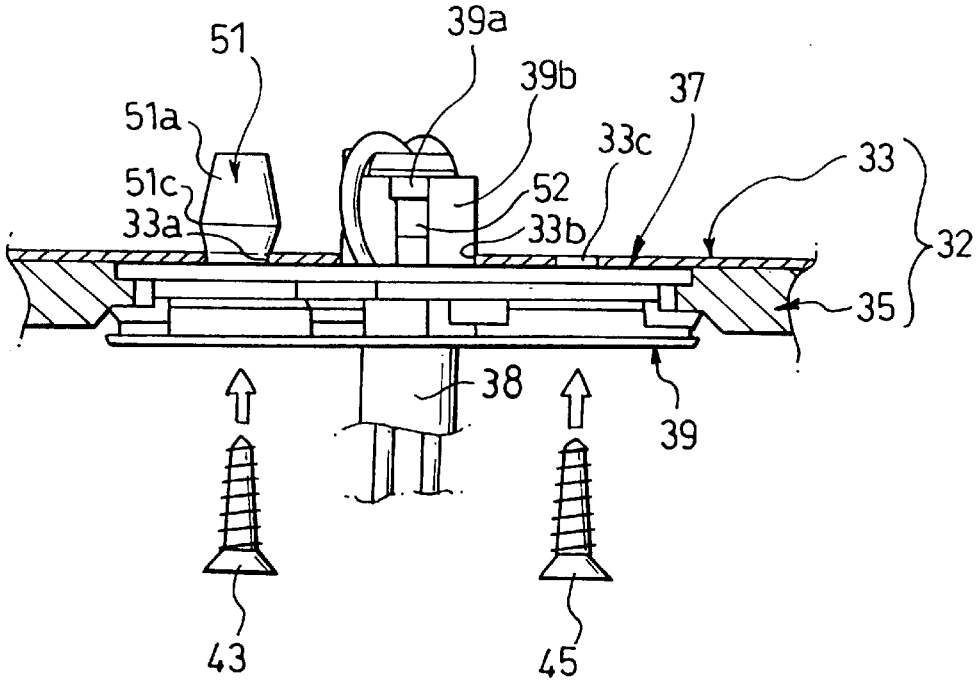

As shown in FIG. 5, the roof trim 35 is provisionally engaged with the roof panel 33 together with the bracket 31 to be attached to a vehicle body via the panel engagement member 51. Therefore, when the first and second conductive screws 43 and 45 are fastened and finally fixed, it becomes unnecessary for a worker to support the bracket body 39 and the roof trim 35 with his hand. Accordingly, the attaching facility can be enhanced.

First, as shown in FIG. 6, when the forward end portions of the first conductive screw 43 penetrates the first and second connecting sections 53 and 34 of the bracket body 39 and the base member 37 and inserted into the panel engagement member 51, a pair of circumferential walls 51*a*, which are capable of being elastically deformed in the radial direction, are expanded. Therefore, the panel engagement member 51 can be fastened with the engaging hole 33*a* of the roof panel 33.

The first conductive screw 43, which has penetrated the first 53 and the second connecting section 34, is screwed into the screw insertion holes of the terminals 56, 41*a* while thread ridges are being formed. Therefore, these terminals 56, 41*a* can be conducted with each other.

When the terminal 41*a* of the power supply electric wire 41 and the terminal 56 of the connection electric wire 42*a* are screwed, the panel engagement member 51, which is substantially cylindrical protrusion, also serves as a screwing section which covers a forward end section 43 of the first conductive screw 43 penetrating the roof panel 33.

The first conductive screw 43 is capable of penetrating the engaging hole 33*a* without causing an electric short circuit when the forward end portion of the first conductive screw 43 comes into contact with the vehicle body panel 33 when it is fastened. Further, the first conductive screw 43 is capable of strongly fastening the bracket body 39 and the base member 37 to the vehicle panel 33.

In this connection, when there is no probability of the occurrence of an electrical short circuit in which the forward end portion of the first conductive screw 43 comes into contact with the vehicle body panel 33, it is unnecessary that the panel engagement member 51 serves as a screwing section. Therefore, the panel engagement member 51 may be composed differently from the screwing section.

On the other hand, as shown in FIG. 7, when the forward end portion of the second conductive screw 45 penetrates the third electrical connecting section 36 of the bracket body 39 and the screw insertion hole 54 of the base member 37 and is inserted into a screwing hole 33*c* of the roof panel 33 and screwed into the terminal 57 and the screwing hole 33 while thread ridges are being formed thereon, the second conductive screw, 45 can conduct with the terminal 57 of the electric wire 42*b* for earth with the roof panel 33.

Therefore, according to the bracket 31 attached to a vehicle body of this embodiment described above, only when the bracket body 39 is fixed to the base member 37 and the roof panel 33 by the first and second conductive screws 43 and 45, the terminal 41*a* of the power supply electric wire 41 and the terminal 56 of the connection electric wire 42*a* can be conducted with each other, and at the same time the terminal 57 of the electric wire 42*b* for earth and the roof panel 33 can be electrically communicated with each other.

That is, it becomes unnecessary to connect connectors for the connection of the power supply electric wire 41 with the connection electric wire 42*a*, and also it becomes unnecessary to connect connectors for the connection of the electric wire 42*b* for earth with the roof panel 33. Further, a high accuracy of engagement is not required for the provisional engagement member composed between the bracket body 39 and the base member 37.

In the case of maintenance in which the sun visor 70 having an illumination device is removed from the roof 32 of a vehicle body, only the following operation may be conducted. After the first and second conductive screws 43 and 45 have been removed, engagement of the bracket body 39 with the base member 37, which is accomplished by the protrusion 39*a* of the provisional engagement member and also accomplished by the elastic piece 52, may be released so as to disconnect the bracket body 39 from the base member 37. Therefore, the base member 37 for holding the terminal 41*a* of the power supply electric wire 41 source can be left on the roof 32 side by the panel engagement member 51.

Due to the foregoing, the number of parts to be removed in the case of maintenance can be decreased, and an excessively high tension does not act on the power supply electric wire 41 in the case of removing parts. Accordingly, the maintenance property can be enhanced.

Accordingly, since it is unnecessary to form the bracket body 39 and the base member 37 with high accuracy, the manufacturing cost can be reduced. Further, there is no probability of damage of the connector and also there is no probability of breaking of wire. Therefore, the present invention can provide an inexpensive bracket 31 for attaching the sun visor 70 having an illumination device capable of being attached with an enhanced attaching facility.

Figure 9:
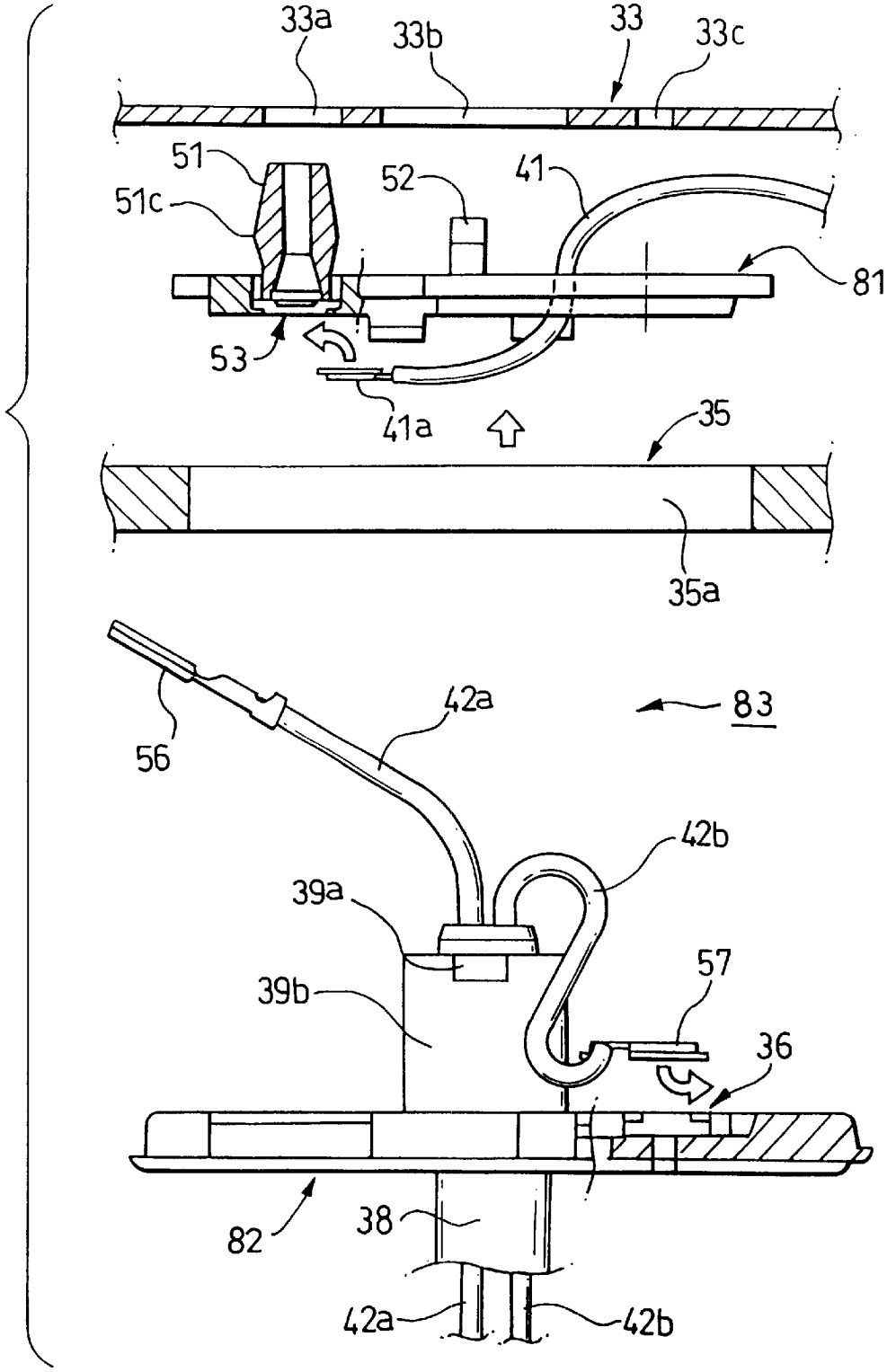
FIG. 9 is an exploded sectional view showing a bracket for attaching a sun visor having an illumination device according to a second embodiment of the present invention.
Figure 10:
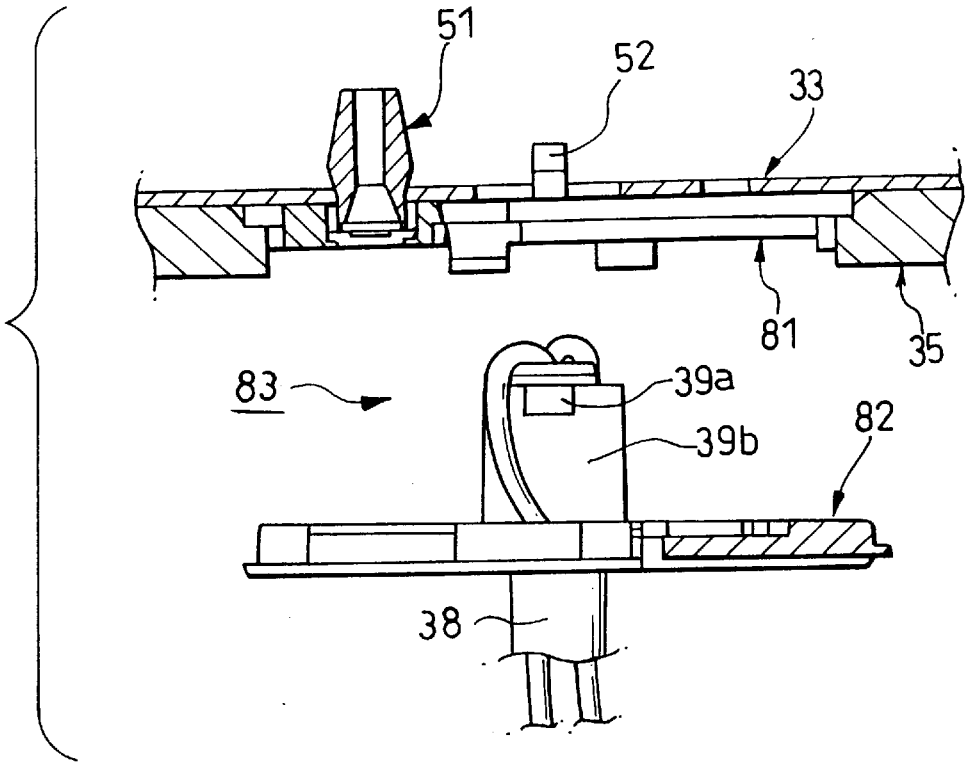
FIGS. 10 and 11 are sectional views for explaining a procedure to assemble the bracket attached to the vehicle body shown in FIG. 9.
Figure 11:
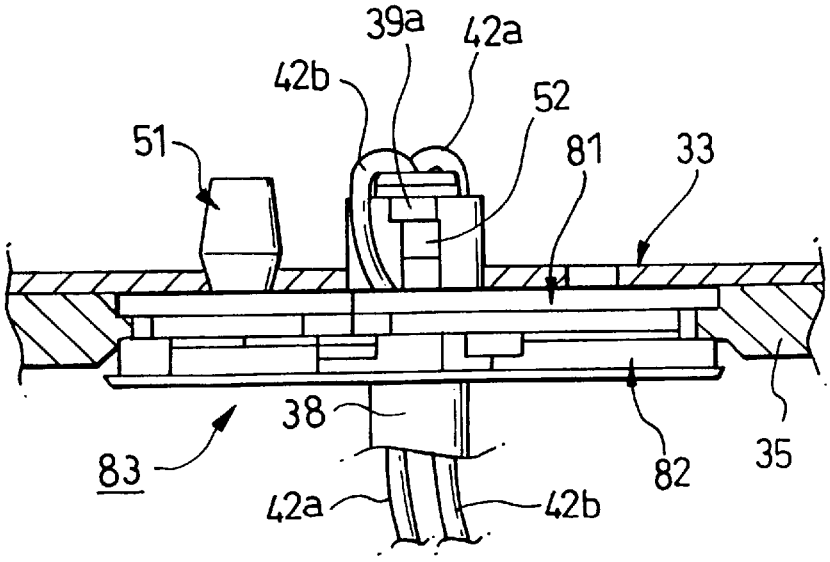
Figure 12:
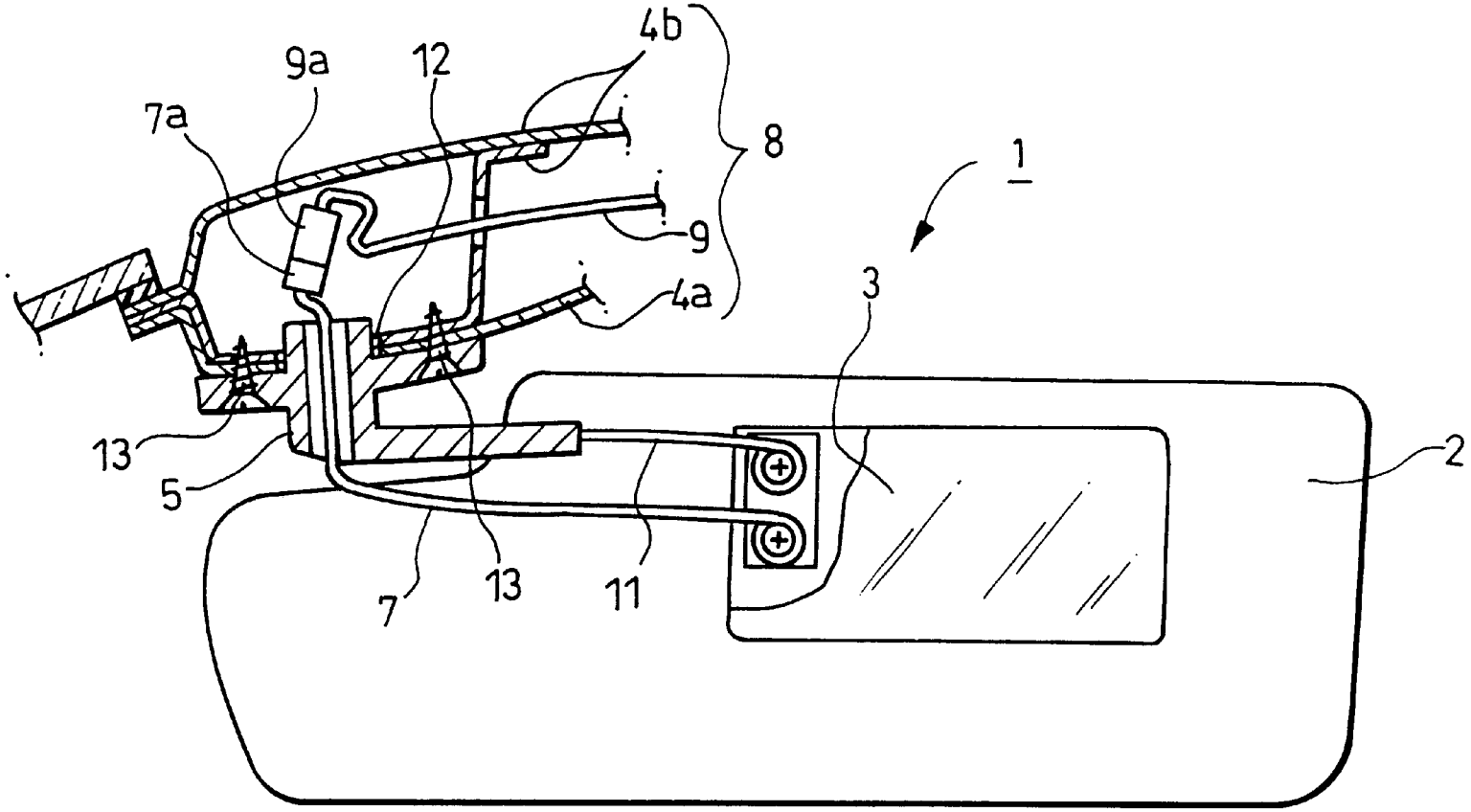
FIG. 12 is a sectional view showing a first related structure for attaching a sun visor having an illumination device.
Figure 13:
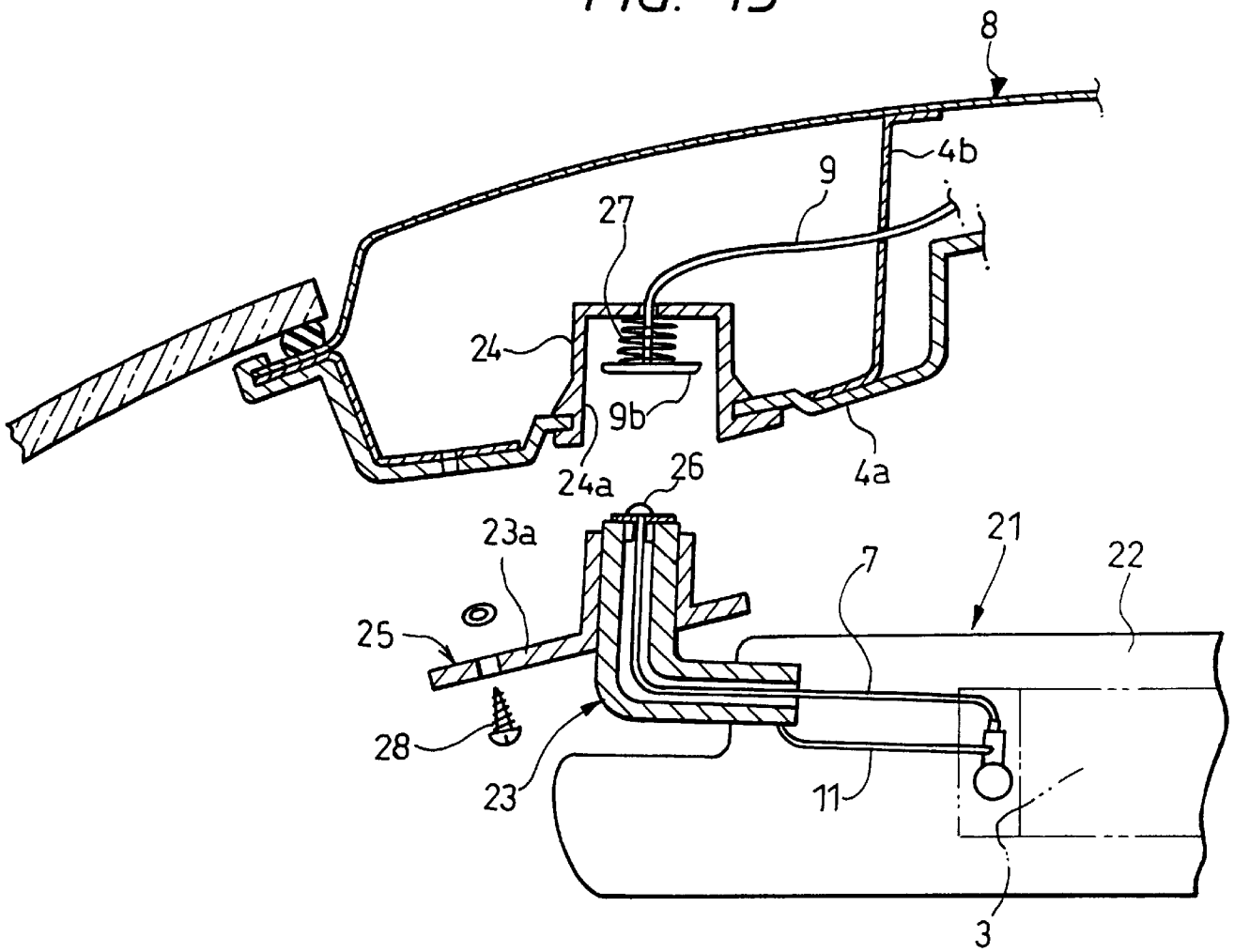
FIG. 13 is a sectional view showing a second related structure for attaching a sun visor having an illumination device.

A bracket 83 for attaching a sun visor having an illumination device to a vehicle body of a second embodiment of the present invention shown in FIGS. 9 to 11 includes a base member 81 and a bracket body 82 in which a trim engagement member 61 of the base member 37 of the bracket 31 is omitted, however, other points of the structure are the same as those of the bracket 31 attached to the vehicle body of the first embodiment described before.

As shown in FIG. 9, in the case of the bracket 83 attached to the vehicle body, after a terminal 41*a* of a power supply electric wire 41 has been positioned at and held by a first connecting section 53 of a base member 81, a panel engagement member 51 of the base member 81 is press-fitted into a fitting hole 33*a* of a roof panel 33. Due to the foregoing, the base member 81 can be engaged with the roof panel 33.

As shown in FIG. 10, after a roof trim 35 has been attached to the roof panel 33, a cylindrical section 39*b* of a bracket body 82 is inserted into an opening of the base member 81, and protrusions 39*a*, which is a provisional engagement member, are engaged with elastic pieces 52 of the base member 81. Due to the foregoing, the bracket body 82 can be provisionally engaged with the roof panel 33, which is covered with the roof trim 35, via the base member 81.

As shown in FIG. 11, the bracket body 82 is provisionally engaged with the roof panel 33 via the panel engagement member 51 of the base member 81. Accordingly, when first and second conductive screws 43 and 45 are fastened and finally fixed, it is unnecessary for a worker to hold the bracket body 82 with his hand. Therefore, the attaching facility can be enhanced.

Consequently, the bracket 83 attached to a vehicle body of the second embodiment can provide the same effect as that of the bracket 31 of the first embodiment.

In this connection, the structure of the bracket of the present invention is not limited to the above specific embodiments, and variations may be made by one skilled in the art without departing the spirit and scope of the present invention. For example, the illumination lamp is used as electrical equipment attached to the sun visor in the above embodiment, however, a microphone and others may be used as electrical equipment attached to the sun visor.

What is claimed is:

1. A modular connector for attaching an interior equipment of a vehicle onto an interior wall member covering an inner face of a vehicle body panel, comprising:

a plate-shaped base member provided with a through hole, and disposed between the vehicle body panel and the interior wall member such that the through hole is arranged on an opening formed in the interior wall member;

a fitting member formed on the base member, which is fitted into a fitting hole formed in the vehicle body panel;

a bracket provided with a base plate to which the interior equipment is attached and a cylindrical portion protruded from the base plate which is to be inserted through the through hole of the base member so as to hold the interior wall member therebetween;

a provisional engagement member formed on the bracket, which is engaged with the base member provisionally when the cylindrical portion is inserted into the through hole of the base member;

a first electric wire arranged between the vehicle body panel and the interior wall member, and led out from the through hole of the base member;

a first terminal provided on a leading end of the first electric wire and fixed on the base member so as to face the bracket;

a second electric wire and a third electric wire led out from the interior equipment and extending through the inside of the cylindrical portion of the bracket;

a second terminal provided on a leading end of the second electric wire and fixed on the base plate of the bracket at a portion opposing to the first terminal when the bracket is engaged with the base member;

a third terminal provided on a leading end of the third electric wire and fixed on the base plate of the bracket;

a first conductive screw piercing through the first and second terminals for electrically connecting the first and second electric wires and for fixing the bracket onto the base member; and a second conductive screw piercing through the third terminal and the vehicle body panel for grounding the third electric wire and for fixing the base member onto the vehicle body panel.

2. The modular connector as set forth in claim 1, wherein the base member is provided with an engagement member for engaging with the opening of the interior wall member.

3. The modular connector as set forth in claim 1, wherein the fitting member has a cylindrical body in which the first conductive screw is inserted so as to expand the cylindrical body outwards.

* * * * *